US006050926A

United States Patent [19]

Purdie

[11] Patent Number: 6,050,926

[45] **Date of Patent: *Apr. 18, 2000**

[54] HAND BASE FOR PUSH-UPS

[75] Inventor: Joe E. Purdie, Bonita, Calif.

[73] Assignee: Joe E. Purdie, D.D.S. A Dental Corporation

[ * ] Notice: This patent is subject to a terminal disclaimer.

[21] Appl. No.: 09/042,704

[22] Filed: Mar. 17, 1998

Related U.S. Application Data

[63] Continuation of application No. 08/799,215, Feb. 18, 1997, Pat. No. 5,910,074.

[51] Int. Cl.[7] ..... A63B 26/00

[52] U.S. Cl. ..... 482/141; 482/907

[58] Field of Search ..... 482/907, 141, 482/142, 91, 908, 148

[56] References Cited

U.S. PATENT DOCUMENTS

| | | | |
|---|---|---|---|
| D. 212,021 | 8/1968 | Gregory | 482/37 |
| 239,970 | 4/1881 | Madart | 482/37 |
| 1,660,130 | 2/1928 | Kolos | 482/38 |
| 3,643,942 | 2/1972 | Williams | 482/36 |
| 3,879,033 | 4/1975 | Martin | 272/60 R |
| 4,337,942 | 7/1982 | Sidlinger et al. | 272/144 |
| 4,358,106 | 11/1982 | Shadford | 272/93 |
| 4,610,448 | 9/1986 | Hill | 272/93 |
| 4,620,701 | 11/1986 | Mojden | 482/41 |
| 5,205,802 | 4/1993 | Swisher | 482/141 |
| 5,226,868 | 7/1993 | Montgomery | 482/141 |
| 5,259,824 | 11/1993 | Cheltenham | 482/114 |
| 5,421,800 | 6/1995 | Mullen | 482/14 |
| 5,466,206 | 11/1995 | Fleming | 482/141 |
| 5,472,400 | 12/1995 | Royer | 482/141 |
| 5,607,380 | 3/1997 | Duty | 482/38 |
| 5,662,556 | 9/1997 | Gangloff | 482/38 |

FOREIGN PATENT DOCUMENTS

| | | | |
|---|---|---|---|
| 739124 | 9/1943 | Germany | 482/38 |
| 115889 | of 0000 | Switzerland | 482/38 |
| 2270636 | 3/1994 | United Kingdom | 482/141 |

OTHER PUBLICATIONS

Catalog: Perform Better. M–F Athletic Company, 11 Amflex Drive, P.O. Box 8090, Cranston, RI 02920–0090. p. 37. 1997.

*Primary Examiner*—Jerome Donnelly
*Attorney, Agent, or Firm*—John L. Rogitz

[57] ABSTRACT

A push-up device includes a base that has a rubber-padded bottom and opposed long flanges rising from the bottom. A series of apertures is formed in each flange to establish a series of aperture pairs, such that two wood dowels can be positioned through respective aperture pairs to establish respective hand holds for the left and right hands of a user. The distance between the dowels can be established as desired by the user by positioning the dowels in the appropriate aperture pairs. Alternatively, the apertures in each flange can be connected to each other to establish a long channel having a series of enlarged bays. In still another embodiment, an elongated rectangular base with opposed long flanges rising from the bottom of the base includes transverse hand ramps that span the flanges, with the hand ramps being angled relative to the base. The angle of successive hand ramps relatively to the horizontal plane becomes increasing acute, moving from the center of the base outwardly.

6 Claims, 1 Drawing Sheet

HAND BASE FOR PUSH-UPS

This application is a continuation application of U.S. patent application Ser. No. 08/799,215, filed Feb. 18, 1997 now U.S. Pat. No. 5,910,074.

FIELD OF THE INVENTION

The present invention relates generally to exercise equipment, and more particularly to apparatus for facilitating and promoting push-up exercises.

BACKGROUND

Executing push-ups is a well-known healthful exercise for developing and maintaining a strong upper body and general cardiovascular fitness. To execute a push-up, a person faces the ground in a prone position and supports himself or herself on the toes and hands, with the spacing between the hands being variably established as appropriate for focussing the exercise on a particular muscle group. For example, placing the hands relatively close together focusses the exercise on the triceps, whereas placing the hands relatively far apart focusses the exercise on the shoulders. The person then alternatingly pushes up and lowers himself or herself relative to the ground, all the while supporting himself or herself on the toes and hands only.

While it is beneficial to perform push-ups on the ground, the present invention recognizes that it is difficult and unpleasant to perform push-ups on uneven, rough, or gravelly ground. More specifically, a person can abrade, cut, and otherwise injure his or her hands when performing push-ups on rough ground. Furthermore, as recognized herein a person's hands can slip apart and cause the person to fall face down when the person performs push-ups on wet ground, such as wet grass, again potentially causing injury. Indeed, hand slippage can undesirably occur on any surface, particularly when the person places his or her hands relatively far apart. The present invention recognizes, however, that it is possible to provide a device for promoting and facilitating safe, efficient execution of push-ups without undue risk.

Accordingly, it is an object of the present invention to provide a device for facilitating push-ups. Another object of the present invention is to provide a device for facilitating push-ups which permits variable spacing between the hands. Yet another object of the present invention is to provide a device for facilitating push-ups that is configured for optimal hand placement on hand holds on the device during push-ups. Still another object of the present invention is to provide a device for facilitating push-ups that is easy to use and cost-effective.

SUMMARY OF THE INVENTION

A device for facilitating push-ups includes a base defining a bottom and front and rear sides. Front and rear long flanges extend along the sides of the base and rise upwardly relative to the bottom of the base, and the flanges define respective front and rear inner vertical surfaces when the bottom of the base is positioned on the ground. Left and right hand holds extend between the front and rear vertical surfaces, with the hand holds being configured for grasping thereof by a person's hand. In a preferred embodiment, a layer of rubber is attached to the bottom of the base to prevent sliding of the base on a surface.

In one embodiment, the front and rear flanges are formed with plural apertures, the hand holds are dowels, and each dowel is respectively received in an aperture in the front flange and an aperture in the rear flange, such that each dowel spans the space between the vertical surfaces. In this embodiment, the base defines a long axis terminating in left and right ends and a midpoint between the ends, and each aperture in the front flange is associated with an aperture in the rear flange to define a pair of associated apertures. A line connecting associated apertures is perpendicular to the vertical surfaces, and each dowel is disposed in a pair of associated apertures. Moreover, the apertures are arranged such that the distance between a pair of associated apertures on a left side of the base and the midpoint of the base is equal to the distance between the midpoint and a pair of associated apertures on a right side of the base. If desired, the flanges can be formed such that each aperture communicates with adjacent apertures.

In another embodiment, the base defines a midpoint, a left direction, and a right direction, and the device includes plural hand holds on the base left of the midpoint and plural hand holds on the base right of the midpoint. In this alternate embodiment, the hand holds are arranged in pairs, with each pair of hand holds including a hand hold left of the midpoint and a hand hold right of the midpoint. As disclosed in further detail below, the hand holds in a pair are equidistant from the midpoint.

In an inventive feature of this second embodiment, each hand hold includes a ramp surface that defines an angle relative to the bottom of the base. Furthermore, the angles of the ramp surfaces of hand holds in a pair are equal to each other, and the angles of the hand hold pairs become progressively steeper, from the mid-most pair to the outer-most pair.

In another aspect of the present invention, an exercise device includes a base, and front and rear flanges extend along front and rear sides of the base and rise upwardly relative to the base. The flanges are formed with plural apertures. Left and right dowels respectively engage pairs of apertures, the dowels being configured for grasping thereof by a person's hand.

In still another aspect, an exercise device, includes a base defining a midpoint, a left direction, and a right direction. Front and rear flanges extend along front and rear sides of the base and rise upwardly relative to the base. In accordance with the discussion below, the flanges define respective front and rear surfaces- Plural hand holds are on the base left of the midpoint and plural hand holds are on the base right of the midpoint.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
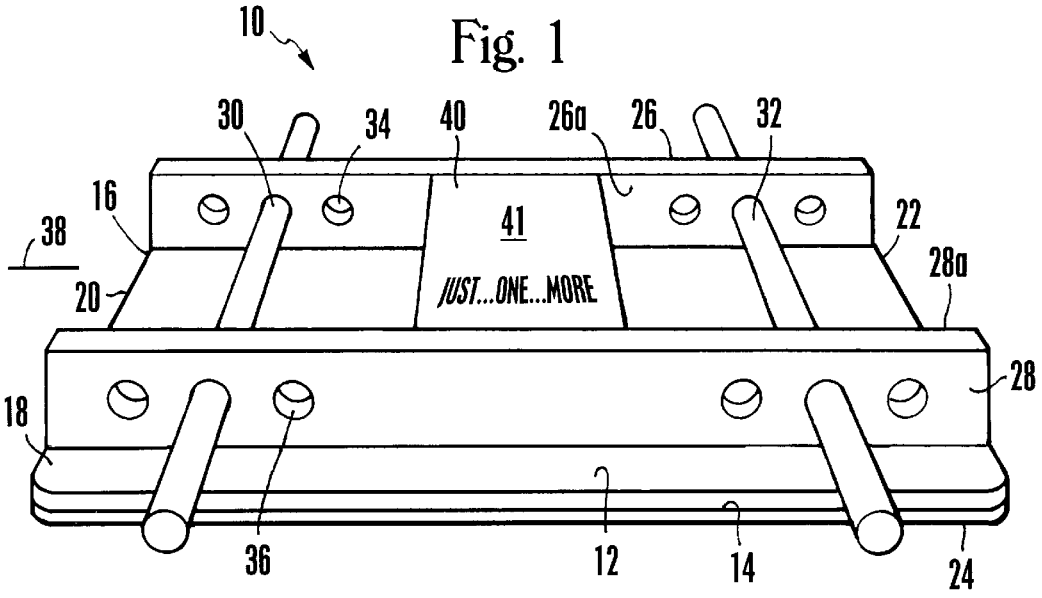
FIG. 1 is a perspective view of the push-up device of the present invention, showing wood dowel hand holds positioned in hand hold aperture.

Referring initially to FIG. 1, a preferably rigid plastic molded device is shown, generally designated 10, for facilitating push-ups. As shown, the device 10 includes a generally parallelepiped-shaped base 12 defining a planar bottom 14, front and rear sides 16, 18, and left and right ends 20, 22, with the base 12 being elongated from the left end 20 to the right end 22. To increase friction between the bottom 14 of the base 12 and a surface on which the bottom 14 is disposed, a layer 24 of friction material, e.g., rubber or frictional plastic, is attached to the bottom 14 by adhesive or by fasteners.

FIG. 1 shows that generally parallelepiped-shaped front and rear long flanges 26, 28 extend along the sides 16, 18 of the base 12 and rise upwardly relative to the bottom 14 of the base 12. As FIG. 1 shows, the flanges 26, 28 define respective front and rear inner vertical rectangular surfaces 26*a*, 28*a*, with the surfaces 26*a*, 28*a* facing each other.

In accordance with the present invention, left and right hand holds extend between the front and rear vertical surfaces 26*a*, 28*a*. Per present principles, the hand holds are configured for grasping thereof by a person's hand. In the embodiment shown in FIG. 1, the hand holds are established by left and right solid cylindrical wood dowels 30, 32.

To selectively hold the dowels 30, 32, the front and rear flanges 26, 28 are perforated with plural front and rear apertures 34, 36, respectively. Although only six pairs of apertures are shown in FIG. 1, it is to be understood that at least two pair and up to twelve pair (and indeed perhaps more than twelve pair) of apertures may be provided. Each dowel 30, 32 is received in a front aperture 34 in the front flange 26 and a rear aperture 36 in the rear flange 28. As intended by the present invention, each front aperture 34 has an associated rear aperture 36 to thereby establish a pair of apertures. From another aspect, the base 12 defines a long axis 38 that passes through the left and right ends 20, 22, and a midpoint 40 is defined on the axis 38 between the ends 20, 22. Each front aperture 34 is associated with an rear aperture 36 to define a pair of associated apertures, wherein a line connecting associated apertures 34, 36 is perpendicular to the vertical surfaces 26*a*, 28*a*of the flanges 26, 28.

As further shown in FIG. 1, the apertures 34, 36 are arranged such that the distance between a pair of associated apertures 34, 36 on a left side of the base 12 and the midpoint 40 is equal to the distance between the midpoint 40 and a pair of associated apertures 34, 36 on a right side of the base 12. Any two such aperture pairs establish a set of four apertures, the aperture pair 34, 36 on the left side of the base 12 being, in essence, mirror complements to the aperture pair 34, 36 on the right.

With the above-described structure, it may now be appreciated that a person can position the dowels 30, 32 in any pair of apertures 34, 36 desired by the user. Preferably, the dowels 30, 32 are disposed in a set of apertures. For example, the person might position the dowels 30, 32 in the set of apertures that is closest to the midpoint 40, to focus the exercise on the triceps. Or, the person might dispose the dowels 30, 32 in the set of apertures that is furthest from the midpoint 40, to focus the exercise on the shoulders. The person next grasps the left dowel 30 with his or her left hand, and grasp the right dowel 32 with his or her right hand. Then, the person can perform a series of push-ups without having to place his or her hands on a rough, slippery, or otherwise unsuitable surface. If desired, the base 12 can include a central raised portion 41 that can be inscribed with a motto as shown.

Figure 2:
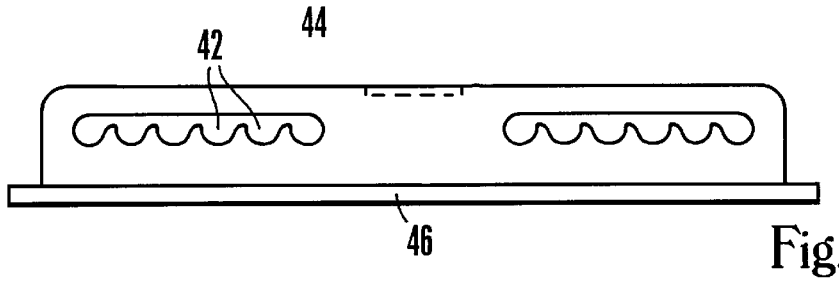
FIG. 2 is a side view of an alternate embodiment of the device shown in FIG. 1, wherein adjacent hand hold apertures communicate with each other, with the wood dowels removed for clarity.

FIG. 2 shows that in an alternate embodiment, apertures 42 in a flange 44 of a base 46 can communicate with each other. In essence, the portion of the flange 44 between the top half of adjacent apertures 42 is removed. With this structure, a person need not slide dowels completely forward or behind the base 46 and then reinsert the dowels lengthwise into another aperture pair to vary the hand distance, but instead need only move a dowel a short distance left or right into the next aperture, when it is desired to vary the hand distance. Because the bottom half of the apertures are continuous, however, the dowels remain in the apertures 42 in which they are disposed during the exercise. The embodiment shown in FIG. 2 is in all other essential respects identical to the embodiment shown in FIG. 1.

Figure 3:
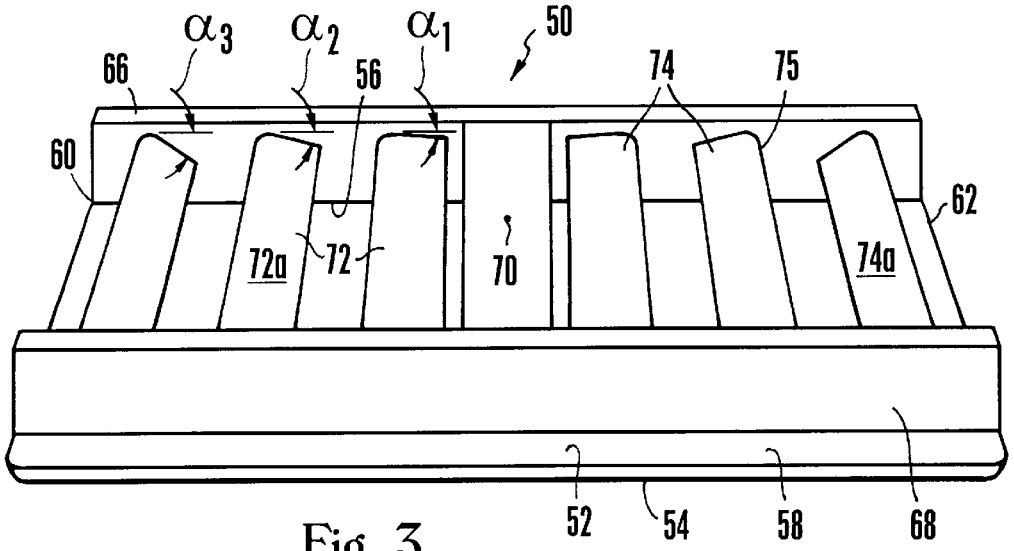
FIG. 3 is a perspective view of an alternate embodiment of the present device, showing pairs of permanently fixed left and right hand hold ramps that are angled relative to a base as appropriate for the spacing between the ramps of each pair.

FIG. 3 shows an alternate device, generally designated 50, that includes a generally parallelepiped-shaped base 52 defining a planar bottom 54, front and rear sides 56, 58, and left and right ends 60, 62, with the base 52 being elongated from the left end 60 to the right end 62. Generally parallelepiped-shaped front and rear long flanges 66, 68 extend along the sides 56, 58 of the base 52 and rise upwardly relative to the bottom 54 of the base 52.

The base 52 defines a midpoint 70, and plural wedge-shaped left hand holds 72 are attached to or formed integrally with the base 52 left of the midpoint 70. Likewise, plural wedge-shaped right hand holds 74 are attached to or formed integrally with the base 52 right of the midpoint 70. The hand holds 72, 74 can extend to the bottom of the base 52 to support the hand holds 72, 74, and each hand hold 72, 74 has a respective curved outboard edge 75 as shown.

Per the present invention, the hand holds 72, 74 are arranged in pairs. More particularly, each pair of hand holds 72, 74 includes a left hand hold 72 and a right hand hold 74, and the hand holds 72, 74 in a pair of hand holds are equidistant from the midpoint 70. Also, adjacent left hand holds 72 are equidistantally spaced, and adjacent right hand holds 74 likewise are equidistantally spaced, as shown.

In the embodiment shown in FIG. 3, each hand hold 72, 74 includes a respective ramp surface 72*a*, 74*a* that is slanted downwardly toward the midpoint 70 relative to the long axis of the base 52 and that extends between the front and rear flanges 66, 68. Inventively, each ramp surface 72*a*, 74*a* defines a respective angle $\alpha_i$ relative to the bottom 54 of the base 52, with the acuteness of the angles $\alpha_i$ of the ramp surfaces 72*a*, 74*a* progressively decreasing, from mid-most hand hold to outer-most hand hold. In other words, the angle $\alpha_1$ between the ramp surface 72*a* of the mid-most left hand hold 72 is almost zero, whereas the angle $\alpha_3$ between the ramp surface 72*a* of the outer-most left hand hold 72 is almost forty five degrees (45°). The angle $\alpha_2$ between the ramp surface 72*a* of the left hand hold 72 that is intermediate the mid-most and outer-most hand hold is about twenty degrees (20°). I have found that the shallower inner angles and steeper outer angles facilitate gripping the respective pairs of hand holds.

While the particular HAND BASE FOR PUSH-UPS as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A device for facilitating push-ups, comprising:

at least one base defining a bottom and front and rear sides;

at least front and rear long flanges extending along the sides of the base and rising upwardly relative to the bottom of the base, the flanges defining respective front and rear inner vertical surfaces when the bottom of the base is positioned on the ground, the front and rear flanges being respectively contiguous to the front and rear sides of the base along the length of the flanges; and one and only one left hand hold and one and only one right hand hold extending between the front and rear vertical surfaces and selectively spaceable therealong by a user, each hand hold contacting both flanges for engagement of the hand hold with the flanges, the hand holds being configured for grasping thereof by a person's hand.

2. The device of claim 1, further comprising a layer of rubber attached to the bottom of the base.

3. The device of claim 1, wherein the front and rear flanges are formed with plural apertures, wherein the hand holds are dowels, and each dowel is respectively received in an aperture in the front flange and an aperture in the rear flange.

4. The device of claim 3, wherein the base defines a long axis terminating in left and right ends and a midpoint between the ends, and each aperture in the front flange is associated with an aperture in the rear flange to define a pair of associated apertures, wherein a line connecting associated apertures is perpendicular to the vertical surfaces, each dowel being disposed in a pair of associated apertures.

5. The device of claim 4, wherein the apertures are arranged such that the distance between a pair of associated apertures on a left side of the base and the midpoint of the base is equal to the distance between the midpoint and a pair of associated apertures on a right side of the base.

6. The device of claim 3, wherein each dowel is a solid cylinder, and each dowel is oriented perpendicularly to the vertical surfaces.

* * * * *